US005370183A

United States Patent [19]

Ellis et al.

[11] Patent Number: 5,370,183

[45] Date of Patent: Dec. 6, 1994

[54] WELL CASING GUIDE STRING AND REPAIR METHOD

[75] Inventors: H. Andrew Ellis; Erik L. Peterson; Randy D. Reynolds, all of Midland, Tex.

[73] Assignee: Atlantic Richfield Company, Los Angeles, Calif.

[21] Appl. No.: 105,081

[22] Filed: Aug. 11, 1993

[51] Int. Cl.[5] ..... E21B 29/10

[52] U.S. Cl. ..... 166/277; 166/55.7

[58] Field of Search ..... 166/277, 380, 55.7, 166/241.1

[56] References Cited

U.S. PATENT DOCUMENTS

| | | | |
|---|---|---|---|
| 4,466,487 | 8/1984 | Taylor, Jr. | 166/339 |
| 4,526,232 | 7/1985 | Hughson et al. | 166/277 X |
| 4,538,684 | 9/1985 | Sheffield | 166/277 |

*Primary Examiner*—William P. Neuder
*Attorney, Agent, or Firm*—Michael E. Martin

[57] ABSTRACT

Well casing is repaired using a guide string for maintaining contact with a lower casing section disposed in the well, particularly an open hole portion of such well. The guide string is connected to a swivel and milling tool and lowered into the casing section remaining in the open hole portion of the well for machining the upper end of the casing section. The swivel prevents build-up of angular momentum of the guide string which may decouple the guide string from the milling tool when the milling tool rotatably decelerates or snags during the machining or milling operations. The milling tool and swivel may be retrieved and the guide string, with a safety joint or fishing head, reinserted in the well during installation of a new casing section.

6 Claims, 3 Drawing Sheets

WELL CASING GUIDE STRING AND REPAIR METHOD

BACKGROUND OF THE INVENTION

1. Field of the Invention

The present invention pertains to an improved guide string arrangement and repair method for well casing wherein the casing guide string below the repair point is connected to a casing milling tool by a swivel joint to prevent unwanted decoupling of the guide string from the work string.

2. Background

In well casing repair operations it is known to utilize any elongated section of drill pipe known as a guide string for installation in a section of casing, particularly when the casing is disposed in an open hole portion of the wellbore, to facilitate locating the separated portion of the casing for repair operations and for connection to a new section of casing. The so called guide string is disposed in the portion of the casing remaining in the wellbore for locating or piloting the new section of casing and for locating or piloting a casing repair mill.

However, the guide string, which may be coupled sections of drill pipe or flush joint pipe up to several hundred feet in length will, when connected below a casing repair milling tool or the like, impose sufficient angular momentum or flywheel effect as to cause unwanted decoupling of the guide sting from the milling tool if the milling tool abruptly stops or decelerates due to rough or jagged casing edges encountered by the cutting edges of the milling tool. The present invention overcomes this problem with an improved guide string assembly and casing repair method.

SUMMARY OF THE INVENTION

The present invention provides an improved guide string for use in well casing repair operations and an improved repair method wherein the guide string is unlikely to undergo decoupling from the casing milling tool or a portion of the drill string or work string supporting the milling tool and the guide string during casing repair work.

In accordance with an important aspect of the present invention a casing guide string is connected to a casing milling tool below the tool and disposed in a section of casing being repaired by a swivel member which permits rotation of the drill string or work string and the milling tool connected thereto while allowing the guide string to remain stationary and not generate any angular momentum or flywheel effect during rotation of the milling tool. In this way inadvertent decoupling of the guide string from the milling tool or decoupling of the milling tool from the drill string is less likely to occur.

The present invention also provides a unique guide string assembly for use in casing repair operations and the like wherein the guide string is connected to a casing repair tool or mill by a swivel member which permits rotation of the tool without rotating the guide string itself.

Those skilled in the art will recognize additional benefits and superior features of the present invention upon reading the detailed description which follows in conjunction with the drawing.

DESCRIPTION OF PREFERRED EMBODIMENTS

Figure 1:
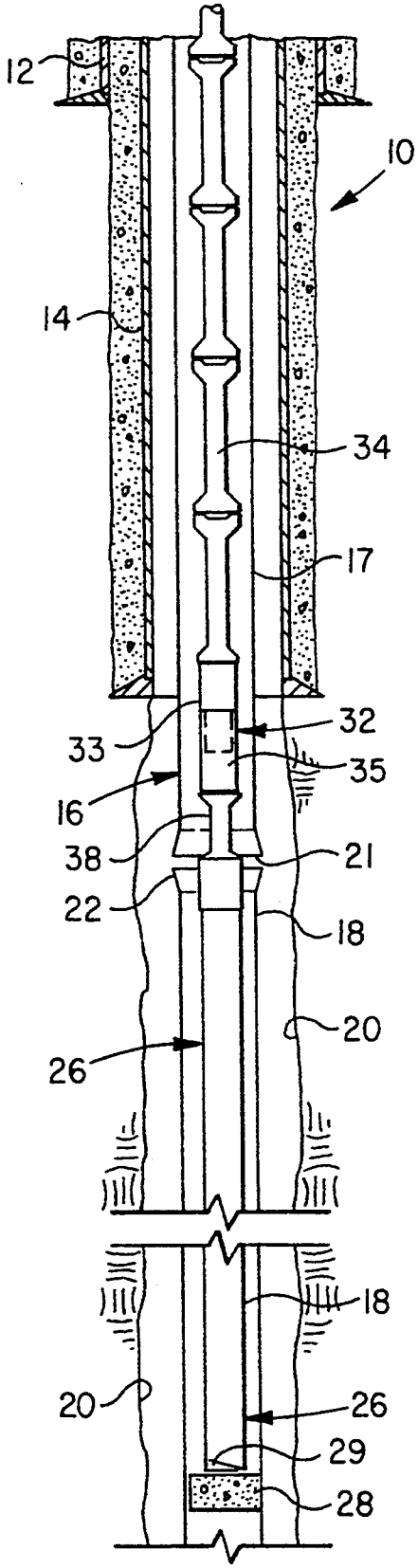
FIGS. 1 through 6 are diagrams illustrating, sequentially, certain steps in carrying out a casing repair method in accordance with the invention.

In the description which follows like parts are marked throughout the specification and drawing with the same reference numerals, respectively. The drawing figures are not to scale and are in substantially schematic form in the interest of clarity and conciseness.

Figure 2:
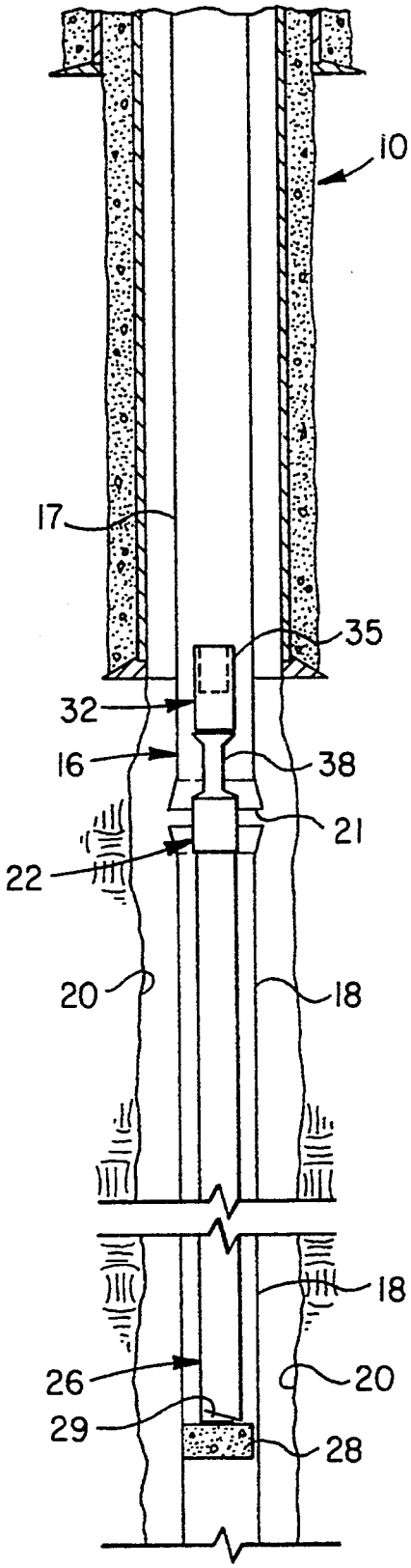

Referring to FIG. 1 there is illustrated a well, generally designated by the numeral 10, in which multiple casing strings 12, 14, and 16 have been installed. In the exemplary well 10, the casing 16 has experienced some damage and at least a part 17 of the casing string 16 is to be removed from the well leaving another part 18 of the casing string in an open hole wellbore portion 20 of the well 10 below the casing 14. As indicated in the diagrams of FIGS. 1 and 2 the casing string 16 is parted at 21 to form the separate casing parts or sections 17 and 18. The section 18 is to remain in the open hole portion 20 of the wellbore and be connected to a new section of casing to be described herein. The casing section 17 is to be removed from the wellbore in a conventional manner after being separated from the section 18. This separation may be accomplished in several ways through failure of the casing, through intentional separation by milling or blasting or the like. Typically in an open hole portion of a wellbore such as the portion 20, the wellbore diameter is sufficiently large that the casing section 18 may become dislocated or leaned over against the wellbore wall after removal of the section 17. This presents certain problems in aligning the casing section 18 for connection to a new casing section and problems in repairing or dressing up the damaged upper end portion 22 of the casing section 18. Enlarged diameter open hole wellbore portions are likely to occur when, for example, compressed air is used as the drill cuttings evacuation fluid during the drilling process.

FIG. 1 illustrates the installation of an elongated pipe string or so called guide string 26 within the casing 16 preparatory to removal of the casing section 17 from the wellbore. The guide string 26 may be characterized by an elongated string of end-to-end coupled sections of flush joint pipe several hundred feet in length. Typically, preparation for support of the guide string 26 is carried out by installing a plug 28 in the casing section 18. The plug 28 may be cement or a mechanical device such as a conventional bridge plug. The lower end of the guide string 26 includes a conventional mule shoe element 29. The guide string 26 includes, at its upper end, a conventional so called safety joint generally designated by the numeral 32. The safety joint 32 is characterized by coupled sections of pipe wherein the threaded connection formed between the coupled sections 33 and 35, for example, includes relatively coarse threads to facilitate easy coupling and uncoupling.

The safety joint section 33 is, as illustrated, connected to a drill string or so called work string 34 which extends to the surface, not shown. One or more sections of conventional drill pipe 38 may be interposed between the safety joint 32 and the guide string 26. The safety joint 32 is, preferably, disposed so that it extends well above the upper distal end 22 of the casing section 18 so that when the connection between the work string 34 and the guide string 26 is released, by uncoupling the safety joint section 33 from the section 35 a sufficient amount of guide string and safety joint is extending above the upper and ragged distal end 22 of the casing section 18, as shown in FIGS. 2 and 3, to permit reconnecting the work string or drill string 34 to the guide string 26 when the casing section 17 has been removed from the wellbore.

FIG. 2 illustrates the condition wherein the work string 34 and the safety joint section 33 have been decoupled from the safety joint section 35 and the guide string 26 and removed from the wellbore and the casing section 17. In the condition illustrated in FIG. 2 the well 10 is ready for removal of the casing section 17.

Figure 3:
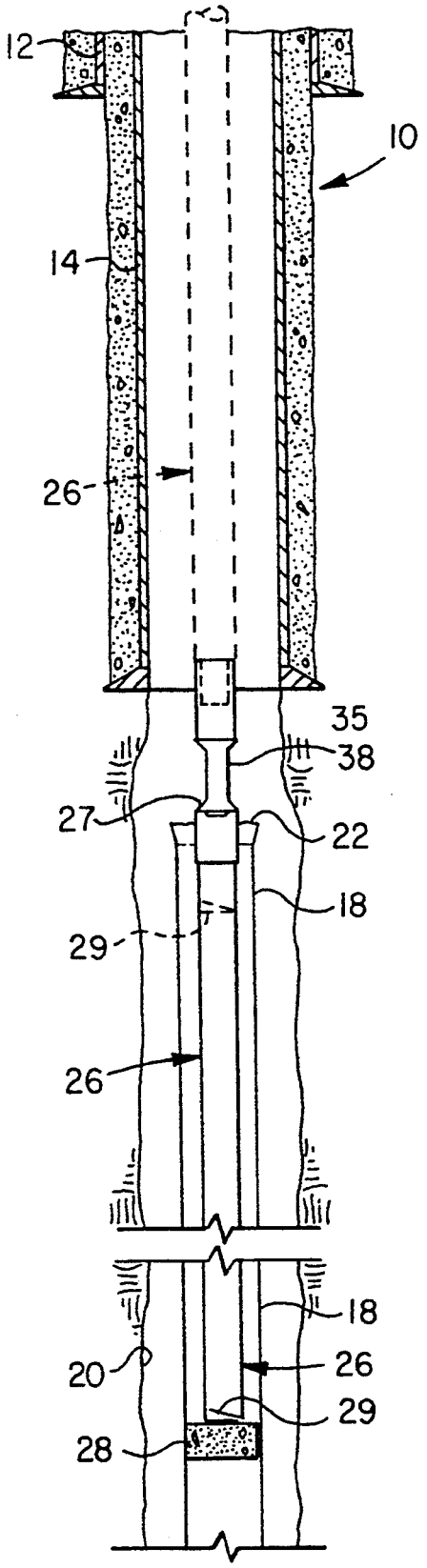
Figure 4:
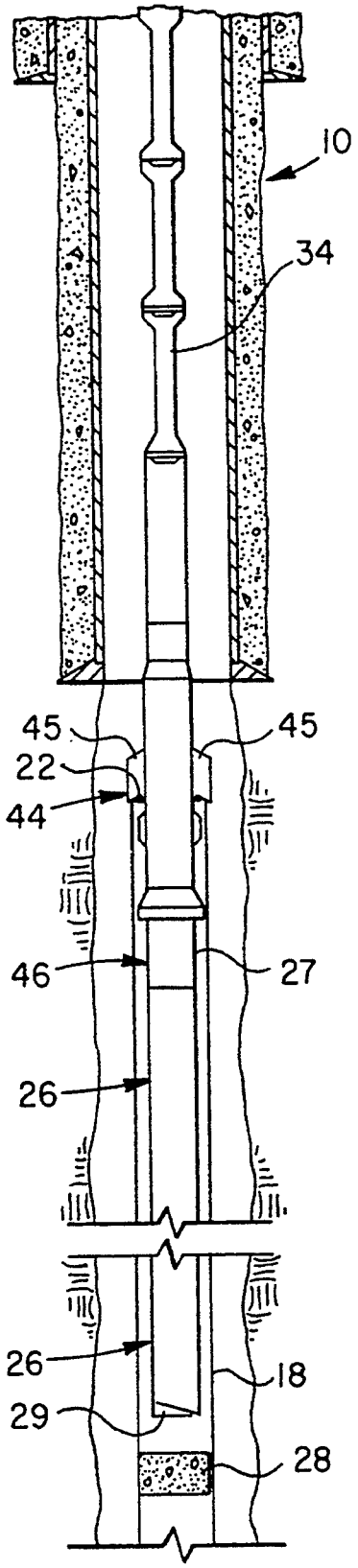

Referring further to FIG. 3, after the casing section 17 is retrieved from the well 10, the drill string or work string 34 together with the safety joint section 33 is reinserted in the well and connected to the safety joint section 35. The guide string 26 is then raised to approximately the position shown by the alternate position lines in FIG. 3 with at least the lower end of the guide string, as indicated by the alternate position of the mule shoe 29, still within the casing section 18 to centralize the casing section 18 in the wellbore. With the upper end 27 of the guide string 26 disposed at or near the surface, not shown, in the raised position of the guide string, the safety joint 35 and drill string section 38 is removed from the guide string 26 and a suitable casing milling tool 44, FIG. 4, and a unique swivel assembly 46 are threadedly connected to the guide string 26. The guide string 26 is then lowered back into the casing section 18 by the drill string or work string 34 until the cutting elements 45 of the mill 44 engage the upper end 22 of the casing section 18.

Upon rotation of the drill string 34, the milling tool 44 will machine the upper end 22 of the casing section 18 to provide a smooth upper end face of the same diameter as the remainder of the casing section 18. In other words the upper end of the casing section 18 is refinished to have the same configuration as the remainder of the casing section. During rotation of the drill string 34 and the milling tool 44 the swivel 46 operates to prevent rotation of the guide string 26 with the drill string 34. In this way the substantial mass of the guide string 26 does not undergo rotation which would create significant momentum or a flywheel effect which, upon snagging or deceleration of the milling tool 44, could cause uncoupling of the guide string 26 from the milling tool 44, or respective sections of the guide string 26 may uncouple from each other as a result of angular momentum of the guide string.

Figure 7:
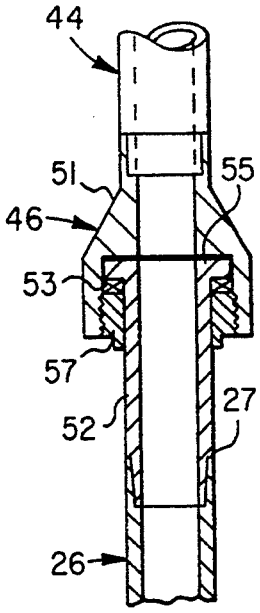
FIG. 7 is a detail section view of an exemplary swivel interposed in the guide string used in the casing repair method.

The swivel 46 may take one of several configurations. However, referring to FIG. 7, an exemplary configuration of a swivel 46 is illustrated. The swivel 46 has an upper box member 51 which is adapted to be threadedly coupled to the milling tool 44 or a suitable intermediate member disposed therebetween. The swivel 46 also has a lower pin member 52 which is adapted to be threadedly coupled to the upper end 27 of the guide string 26. A suitable bearing 53 is interposed between the flanged upper end 55 of the pin member 52 and a retaining collar 57 of the box member 51, which collar is threadedly coupled to the box member, for example. In this way the member 52 is free to rotate relative to the member 51 and vice versa.

Figure 5:
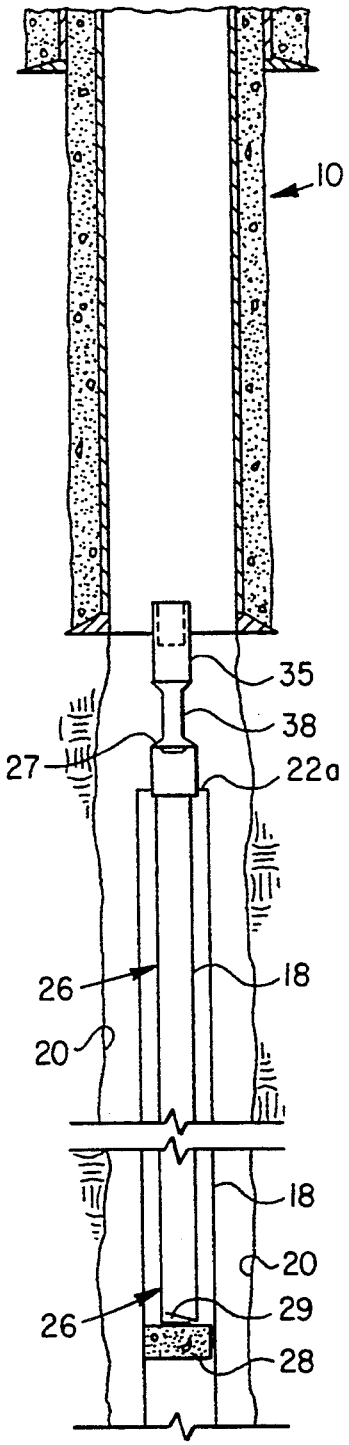

After the upper end 22*a* of the casing section 18 has been restored to a desired condition, as indicated by the dressed and machined transverse end face 22 in FIG. 5, the drill string 34, in assembly with the milling tool 44, the swivel 46 and the guide string 26, is retrieved back to the surface without removing the lower distal end of the guide string comprising the mule shoe 29 from the casing section 18. The drill string section 38 and the safety joint section 35 are then reconnected to the guide string 26 and the guide string is lowered into the casing section 18 until the distal end/mule shoe 29 engages the plug 28 as illustrated in FIG. 5.

Figure 6:
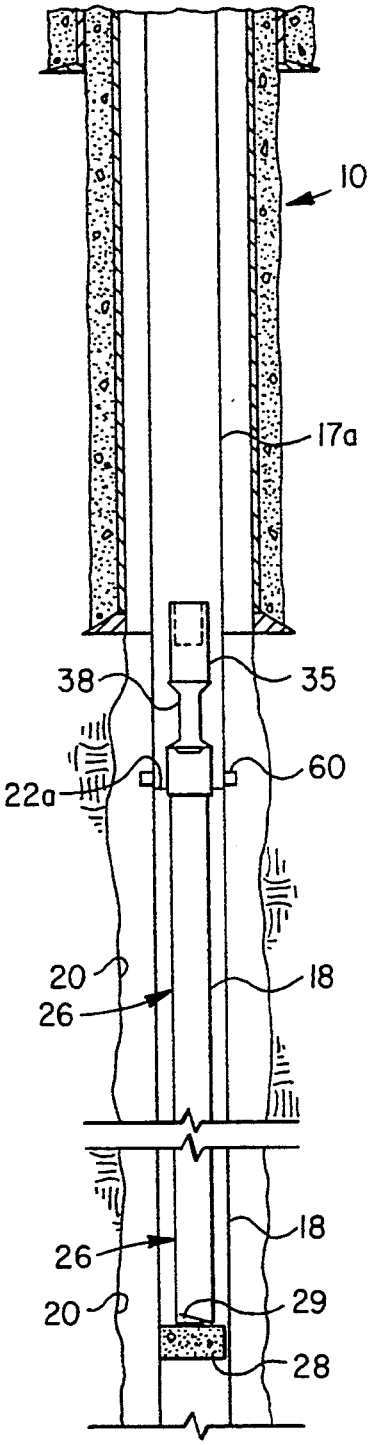

The upper end 27 of the guide string 26 including the drill string section 38 and the safety joint section 35 now serve as a guide for a new casing section 17 which is lowered into the well 10 with a suitable casing bowl 60 connected to the lower distal end thereof and operable to be connected to the casing section 18. The casing bowl 60, sometimes known as a casing patch, may be of a type commercially available such as a type manufactured by Bowen Tools, Inc. of Houston, Tex. Upon connection of the new casing section 17 to the casing section 18 the guide string 26, including the safety joint section 35 and drill string section 38, may then be retrieved from the well 10 in a conventional manner by connecting the safety joint section 35 to the safety joint section 33, not shown in FIG. 6, and drill string or work string 34, also not shown in FIG. 6, connected thereto.

Thanks to the provision of the swivel 46 improved casing repair operations may be carried out without loss of the guide string or the like in the wellbore due to the angular momentum or flywheel effect of the guide string during casing milling operations and the like. The swivel 46 may be made of conventional engineering material as used for down hole tools and equipment used in the oil and gas well drilling industry. The components other than those described in some detail herein may be commercially available or utilize standard commercially available components familiar to those with skill in the art in the oil and gas well drilling industry. Although preferred embodiments of a well casing repair method and guide string assembly have been described in detail herein those skilled in the art will recognize that various substitutions and modifications may be made to the invention without departing from the scope and spirit of the appended claims.

What is claimed is:

1. An assembly for repairing a casing section disposed in a wellbore comprising:

an elongated tubular guide string adapted to be inserted in said casing;

a casing milling tool connected to a work string for rotation to machine the upper end of said casing; and a swivel interconnecting said guide string and said work string including said milling tool whereby said guide string is connected to said milling tool and said work string but is rotationally independent of the rotation of said work string and said milling tool.

2. The assembly set forth in claim 1 wherein:

said swivel includes a first part adapted to be connected to said milling tool and a second part adapted to be connected to said guide string.

3. The assembly set forth in claim 2 including:

bearing means interposed between said first part and said second part to permit substantially free rotation of said parts relative to each other.

4. A method for repairing a well casing which includes a first section having an upward facing end and a second section which is disposed generally above said first section; said method comprising:

inserting a guide string within said well casing and extending into said first casing section, said guide string having an upper end extending above said upward facing end of said first casing section;

removing said second casing section from said wellbore;

lifting said guide string partially out of said first casing section and connecting a milling tool and swivel to said guide string;

lowering the assembly of said milling tool, said swivel, and said guide string into said first casing section and engaging said milling tool with said first casing section; and rotating said milling tool to machine said upper end of said first casing section while permitting free rotative movement of said guide string relative to said milling tool.

5. The method set forth in claim 4 including the step of:

raising said guide string in said first casing section and disconnecting said milling tool and said swivel means from said guide string; and lowering said guide string into said first casing section until said guide string rests on support means for said guide string.

6. The method set forth in claim 5 including the step of:

installing a third casing section in said well above said first casing section, connecting said third casing section to said first casing section and retrieving said guide string from said well.

* * * * *